US008851531B2

(12) United States Patent
Thiriet

(10) Patent No.: US 8,851,531 B2
(45) Date of Patent: Oct. 7, 2014

(54) VEHICLE BODY SHELL AND DEVICE FOR LOCKING THE DOOR IN A CLOSED POSITION

(75) Inventor: Philippe Thiriet, Warcq (FR)

(73) Assignee: Thiriet, Warcq (FR)

( * ) Notice: Subject to any disclaimer, the term of this patent is extended or adjusted under 35 U.S.C. 154(b) by 192 days.

(21) Appl. No.: 13/522,552

(22) PCT Filed: Jan. 19, 2011

(86) PCT No.: PCT/FR2011/000032
§ 371 (c)(1),
(2), (4) Date: Jul. 17, 2012

(87) PCT Pub. No.: WO2011/089339
PCT Pub. Date: Jul. 28, 2011

(65) Prior Publication Data

US 2012/0274082 A1 Nov. 1, 2012

(30) Foreign Application Priority Data

Jan. 19, 2010 (FR) ..... 10 00200

(51) Int. Cl.
*E05C 1/06* (2006.01)

(52) U.S. Cl.
USPC ..... 292/144; 292/341.15; 292/341.17

(58) Field of Classification Search
USPC ..... 292/144, 192, 341.15, 341.17
See application file for complete search history.

(56) References Cited

U.S. PATENT DOCUMENTS

| | | | | |
|---|---|---|---|---|
| 1,880,850 | A | 10/1932 | Dautrick | |
| 3,514,142 | A * | 5/1970 | Smith | 292/113 |
| 3,834,197 | A * | 9/1974 | Sedley | 70/38 C |
| 4,083,424 | A | 4/1978 | Von Den Stemmen et al. | |
| 4,211,443 | A * | 7/1980 | Butts et al. | 292/341.16 |
| 4,866,963 | A | 9/1989 | Leininger et al. | |
| 2002/0105200 | A1 | 8/2002 | Reynolds et al. | |

FOREIGN PATENT DOCUMENTS

| | | |
|---|---|---|
| DE | 4329617 | 3/1995 |

OTHER PUBLICATIONS

International search report dated May 17, 2011 in corresponding PCT/FR2011/000032.

* cited by examiner

*Primary Examiner* — Mark Williams
(74) *Attorney, Agent, or Firm* — Young & Thompson

(57) ABSTRACT

A vehicle body shell includes an opening provided with at least one door, and at least one device for locking the door in a closed position. The shell includes: a locking member movable between a locked position and an unlocked position, which interacts with a corresponding locking element; an electromagnetic element for moving the locking member from the locked to the unlocked position; and a resilient element for stressing the locking member (from the unlocked to the locked position. The locking member provides temporary control, and the device for locking the door in a closed position includes a supporting element that is movable at least from a first released position, in which the locking member is in the locked position, to a second stable and engaged position, wherein the supporting element engages with the locking member in the unlocked position so as to counter the stress of the resilient element.

19 Claims, 6 Drawing Sheets

VEHICLE BODY SHELL AND DEVICE FOR LOCKING THE DOOR IN A CLOSED POSITION

The invention relates to a vehicle body shell comprising an opening, at least one door provided on said opening, able to close or open said body shell, as well as at least one device for locking the door in a closed position, electrically controlled.

BACKGROUND OF THE INVENTION

In the field of vehicle body shells, in particular road transport, it is known in document U.S. Pat. No. 4,083,424 or in document U.S. Pat. No. 4,866,963 to lock a lift door, thanks to an electrically controlled device for locking. As stated in these documents, this device for locking comprises a mobile lock, stressed to lock by a spring, and controlled to open thanks to an electromagnet. This electrically controlled unit is fixed to the body shell, the mobile lock interacting, at locking or at unlocking, with a corresponding locking element fixed on the lift door.

Document U.S. Pat. No. 4,866,963 provides, furthermore, a supporting element, mechanical, which makes it possible to retain the mobile lock in its unlocked position. To this effect the supporting element can pass, by the action of resilient means, from a released position wherein the lock is in the locked position of the door, to an engaged position of the lock wherein the supporting element mechanically retains the lock in said unlocked position of the lock.

In document U.S. Pat. No. 4,866,963 the mechanism actuating said supporting element to said engaged position is controlled by the physical opening of the door. In document U.S. Pat. No. 4,083,424 or U.S. Pat. No. 4,866,863, the user enters a code on a keyboard which controls the electromagnet, as such causing the moving of the lock from the unlocked position to the locked position. Consecutively, the user has to go to the door and raise it at least partially so that the mechanism moves the supporting element into a position wherein it retains the lock. Consequently, the supporting element of document U.S. Pat. No. 4,866,963 does not make it possible to retain the mobile lock when the door of the body shell is in a closed position.

In document U.S. Pat. No. 4,083,424 or U.S. Pat. 4,866,963, an electric control circuit of the solenoid of the electromagnet implements a timer so that the solenoid is solicited during a sufficient period of time, required to allow the user to lift the door before the mobile lock is again stressed to lock by the action of the spring. For example document U.S. Pat. No. 4,866,963 provides a timer which can be between 60 seconds and 90 seconds giving the user enough time to go to the door, before the mobile lock locks again.

As such, the device of document U.S. Pat. No. 4,083,424 or document U.S. Pat. No. 4,866,963 has the disadvantage of the implementation of an electromagnet solicited during a relatively long period of time, which can be of several seconds, as such reducing its lifespan.

SUMMARY OF THE INVENTION

The purpose of this invention is to overcome the aforementioned disadvantages by proposing a vehicle body shell provided with a door and a device for locking the door in a closed position, implementing an electromagnetic means, such as an electromagnet, which allows for an easy opening of the door, while still increasing the lifespan of the electromagnetic means.

Another purpose of this invention is to propose a device for locking the door of a vehicle body shell provided with a door using a single-pulse strike plate while still mechanically memorising the opening order in order to be able to lift the door without delay and to be able to self lock it during the closing of it.

As such, the invention relates to a vehicle body shell comprising an opening, at least one door provided on said opening, able to close or open said body shell, as well as at least one device for locking the door in a closed position, comprising a movable locking member between a locked position P1 and an unlocked position P2, interacting at locking or at unlocking with a corresponding locking element, an electromagnetic means in order to move the locking member from said locked position P1 to said unlocked position P2, and resilient means to stress the locking member from said unlocked position P2 to said locked position P1, with the device for locking the door in a closed position comprising supporting means, which, on the one hand, are mobile at least between a first released position P3, wherein the locking member is in said locked position P1, to a second stable engaged position P4, wherein said supporting means interact with the locking member in said unlocked position P2 in such a way as to counter the stress of the resilient means by mechanically maintaining the locking member in said unlocked position P2, and on the other hand, are able to be retracted by the action of the locking element during the movement of the door, said supporting means being stressed from said first released position P3 to said second engaged position P4 by spring means.

According to the body shell in accordance with the invention, the locking member provides temporary control and wherein said supporting means are able to maintain the locking member in said unlocked position P2 while the door is in a closed position and wherein when the locking member is actuated by said electromagnetic means from said locked position P1 to said unlocked position P2, the action of the spring means causes the simultaneous moving of the supporting means from the first released position P3 to said second engaged position P4, while the door is in a closed position.

According to an embodiment, the locking member is constituted by a bolt able to be moved in translation between said locked position P1 and said unlocked position P2 and wherein the supporting means are constituted by a pivoting finger, which in said first released position P3 presses on the lateral section of the locking member and which, when said locking member is controlled to open, escapes from the lateral section by the action of said spring means and pivots to said second engaged position P4 wherein an engaged end of said finger comes to support the end of the locking member, on a concave portion of the locking member.

According to optional characteristics:

- the locking member and said supporting means are integral with the body shell and said corresponding locking element integral with the door;
- the supporting means are articulated in such a way as to be retracted by the action of said locking element during the opening of the door;
- once retracted by the action of the locking element, the supporting means are in a position P5 and maintain the locking member in an intermediary position P6 between the locked position P1 and said unlocked position P2;
- said locking element interacts with said supporting means during the movement of the door in such a way as to cause the return of the supporting means in the released position P3;

the return of the supporting means in said released position P3 by the action of the locking element is caused during the closing of the door;

the locking member has an angled corner intended to interact with said locking element, during the closing of the door, in order to move the locking member against the retaining force of the resilient means;

said locking element is constituted of a folded plate having an end interacting through abutment with said locking member, by the intermediary of said supporting means, when the door is in a closed position and said locking member in said locked position P1, said body shell having rails, integral with the body shell, able to guide the end of said folded plate in the vicinity of the locking member during the movement of the door when opening or closing, said locking element is integral with the door by the intermediary of an articulation, a secure locking element, accessible in a removable manner on the exterior of the door allowing for the locking of the articulation, said articulation when released authorising the free opening of the door when the locking member is in said locked position and the door is closed, the door is a lift, sliding or swinging door.

BRIEF DESCRIPTION OF THE DRAWINGS

The invention shall be better understood when reading the following description accompanied with the annexed drawings wherein.

DETAILED DESCRIPTION OF THE PREFERRED EMBODIMENTS

Figure 1:
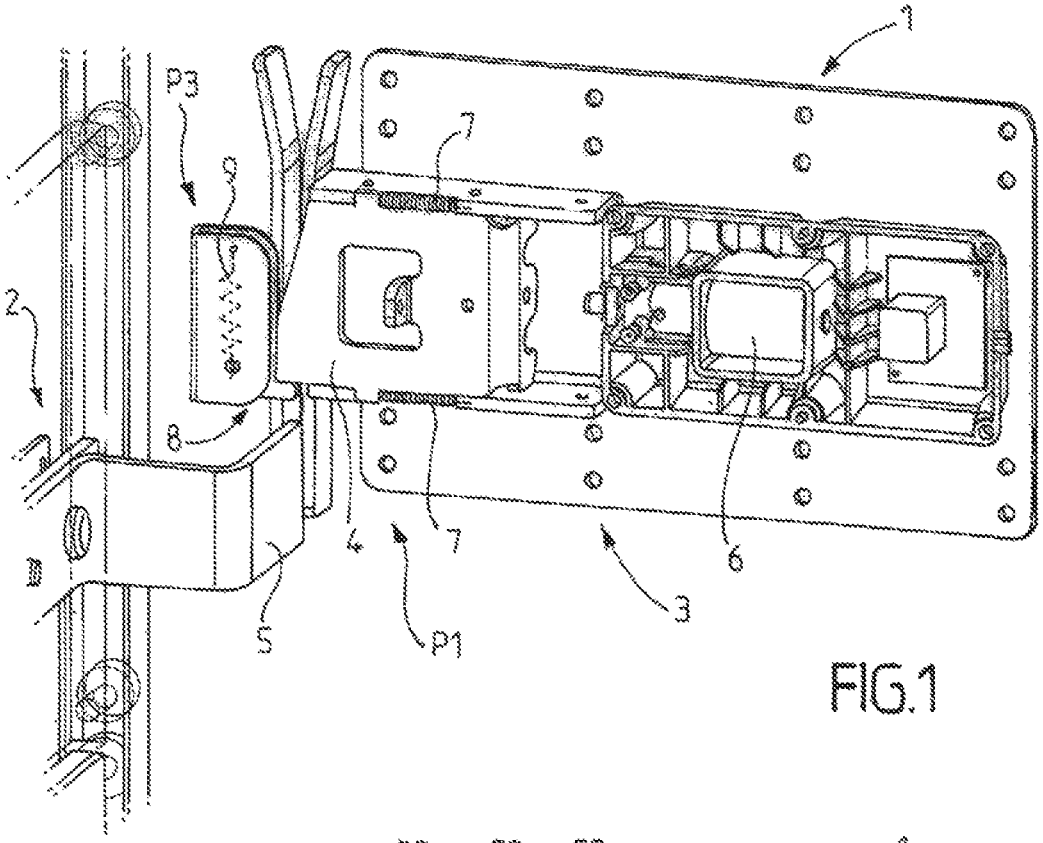
FIG. 1 is a view showing the device for locking of a lift door in a closed position.

As such the invention relates to a vehicle body shell 1 comprising an opening, as well as at least one door 2 provided on said opening, able to close or open said body shell.

This can be in particular, such as shown in the figures, a lift door, constituted substantially of a screen guided in translation on two risers of said opening, thanks to slides. However, the invention is not limited to lift doors and can also be implemented on a sliding or swinging door. The door can be actuated when opening and closing manually, or, thanks to a motorisation.

According to the invention, the body shell further comprises a device 3 for locking of the door 2 in a closed position, comprising a locking member 4 mobile between a locked position P1 and an unlocked position P2 and interacting at locking or at unlocking with a corresponding locking member 5.

More preferably, the locking member is integral with the body shell (fixed portion of the body shell), said corresponding locking element integral with the door (mobile portion of the body shell). However, it is possible to invert the positions by providing the locking member on the door and the locking element fixed to the body shell.

The device 3 for locking further comprises an electromagnetic means 6, such as an electromagnet, in order to move the locking member 4 from the locked position P1 to the unlocked position P2, as well as resilient means 7 in order to stress the locking member 4 from the unlocked position P2 to the locked position P1, According to the invention, the locking member 4 provides temporary control. Furthermore, the device 3 for locking of the door in a closed position comprises supporting means 8.

These supporting means 8 are mobile at least between a first released position P3, wherein the locking member 4 is in said locked position P1, to a second stable engaged position P4, wherein said supporting means 8 interact with the locking member 4 in said unlocked position P2 in such a way as to counter the stress of the resilient means 7, by mechanically maintaining the locking member 4 in said unlocked position P2.

On the other hand, these supporting means 8 are able to be retracted by the action of the locking element 5 during the movement of the door 2, in particular moving in translation in the case of a sliding or lift door, or moving with pivoting in the case of swinging door.

We shall now describe in detail the example embodiment, not restricted, in FIGS. 1 to 12 of which the door is a lift door. As already developed, the invention is not limited to body shells with lift doors and can be implemented on other types of doors, such as sliding doors or swinging doors.

Such as is shown in FIG. 1, the locking member 4, with the electromagnetic means 6 are integral with the body shell 1, the locking element 5 being integral with the door 5.

According to the example, the locking member 4 is constituted of a bolt which is guided in translation between the locked position P1 and the unlocked position P2.

The resilient means 7 are constituted of two compressed springs stressing the locking member from the unlocked position P2 to the locked position P1. The supporting means 8 are provided facing the end of the locking member 4, fixed to the body shell in the vicinity of member 4, and are provided pivoting between the released position P3 and the engaged position P4. Spring means 9 constituted in particular by an extended spring, stress the supporting means from the released position P3 to the engaged position P4.

The direction of translation of the locking member 4 is substantially perpendicular to that of the translation of the door 2. The locking element 5, in particular constituted of a folded metal plate, has an end 51 interacting through abutment with the locking member 4, by the intermediary of the means 8, when the door is closed, the member 4 being in its position P1 in such a way that it is not possible to open the door.

Rails 52, 53 integral with the body shell 1 can make it possible, furthermore, to guide this end 51 in the vicinity of the locking member 4, during the movement of the door when opening or when closing.

Figure 3:
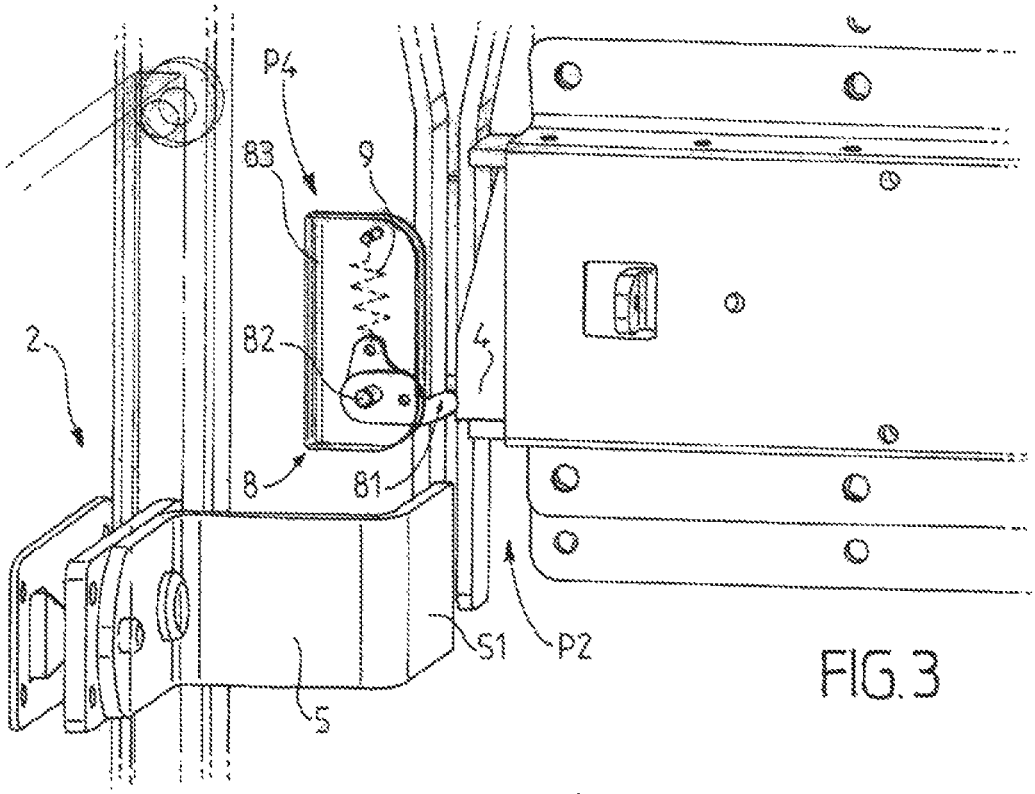
FIG. 3 is a view of the device, such as is shown in FIG. 2 when the door is closed, the locking member being actuated by the action of the electromagnetic means in the unlocked position P2, with the supporting means being in the engaged position P4 with the locking member.

Such as is shown in FIG. 3, the locking member 4, in particular the bolt is actuated in translation by the electromagnetic means 6 to the unlocked position P2 by a temporary control (impulse) of the electromagnetic means 6.

Simultaneously, by the action of the spring means 9, in particular of the extended spring, the supporting means 8 are then moved automatically from the released position P3 to the position P4 such as is shown in FIG. 3.

In this engaged position P4, stable, the supporting means 8 counter the stress of the resilient means 7 by mechanically maintaining the locking member 4 in the unlocked position P2.

Such as shown in the figures, the supporting means 8 can in particular be constituted of a pivoting finger, of which an engaged end 81 comes to interact in the stable engaged position P4, in particular on a concave portion of the bolt constituting the locking member 4, in order to maintain the latter in the position P2.

Figure 2:
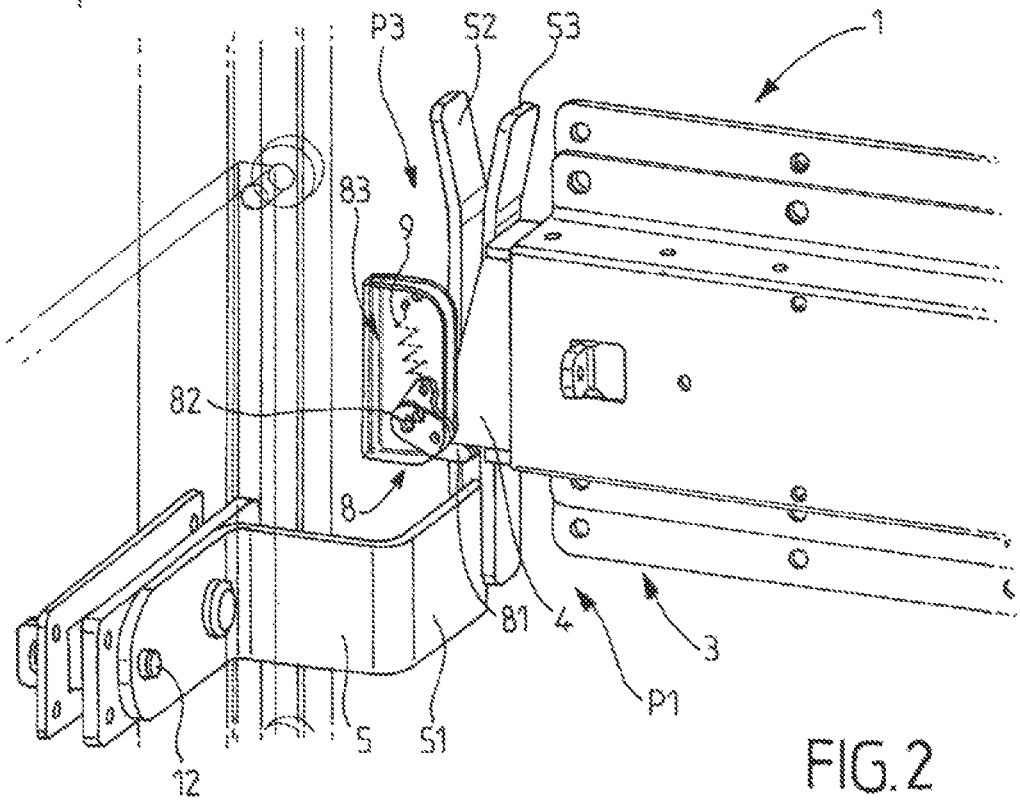
FIG. 2 is a detailed view of FIG. 1, showing the device for locking, the locking member being in said locked position P1, said supporting means being in said released position P3, the lift door in a closed position.

More precisely, such as is shown in FIG. 2, the finger is articulated via a pivot 82 on a support 83, of U-shaped section, which is itself fixed to the body shell. The axis of rotation of the pivot 82 can be substantially perpendicular to the axis of translation of the locking member 4, as well as to the body shell wall whereon the support 83 is fixed.

The finger is provided in the interior portion of the support 83, mounted pivoting between vertical wings of the U-shaped section of the support 83.

The finger has the shape of an L, with one of the ends of the L constituting said engaged end 81 of the finger intended to make contact with the locking member 4 in the position P4 of the supporting means 8, with the other end of the L constituting an anchor point for the end of an extended spring of the spring means 8. The other end of the spring is provided integral with the support 83 on an anchor point of the support. Such as shown, the finger pivots, according to the axis of rotation of the pivot 82 which is perpendicular to the plane of the L, the pivoting axis located on the elbow formed by the two wings of the L.

In the released position P3, the locking member 4 in the locked position P1, the finger presses on one of the lateral sections of the locking member 4 which is in particular parallel to the axis of translation of said member 4. When the locking member 4 is controlled to open, this finger escapes from the lateral section, and by the action of the extended spring, pivots to the stable position P4, so that the engaged end 81 of the finger comes to support the end of the locking member 4 in the unlocked position P2, on a concave portion of the locking member 4.

Figure 4:
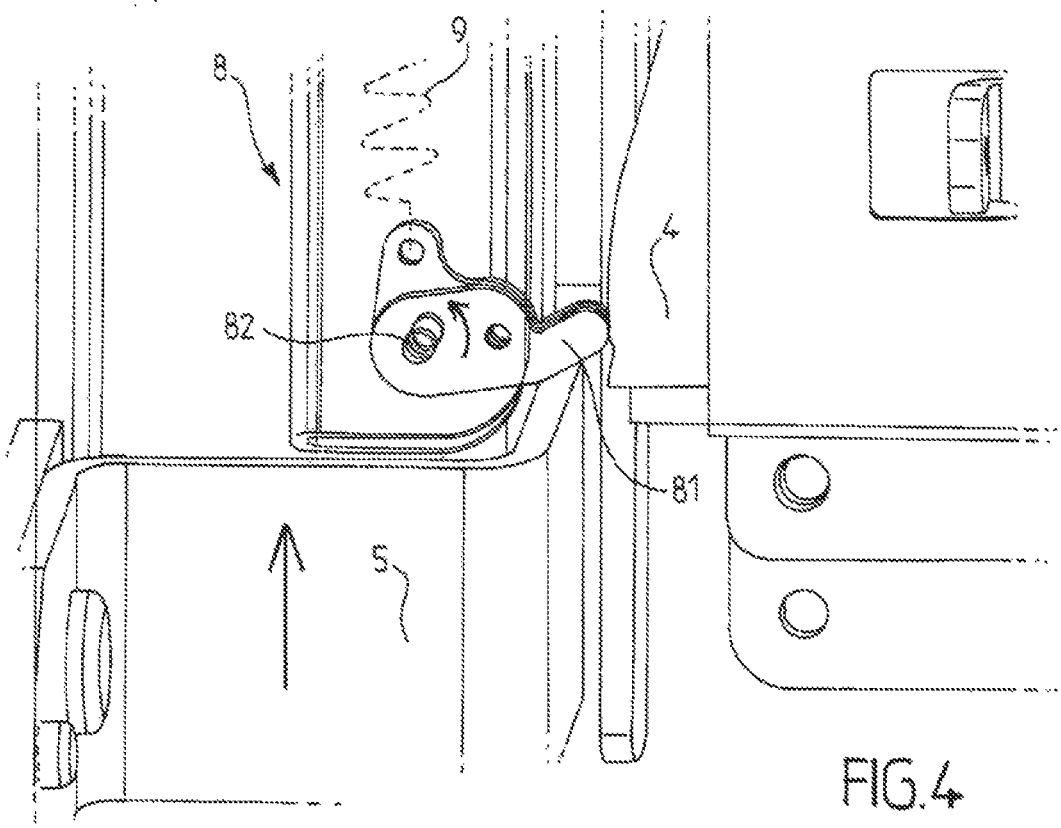
FIG. 4 is a view of the device such as is shown in FIG. 3 when the door initiates a moving when opening.
Figure 5:
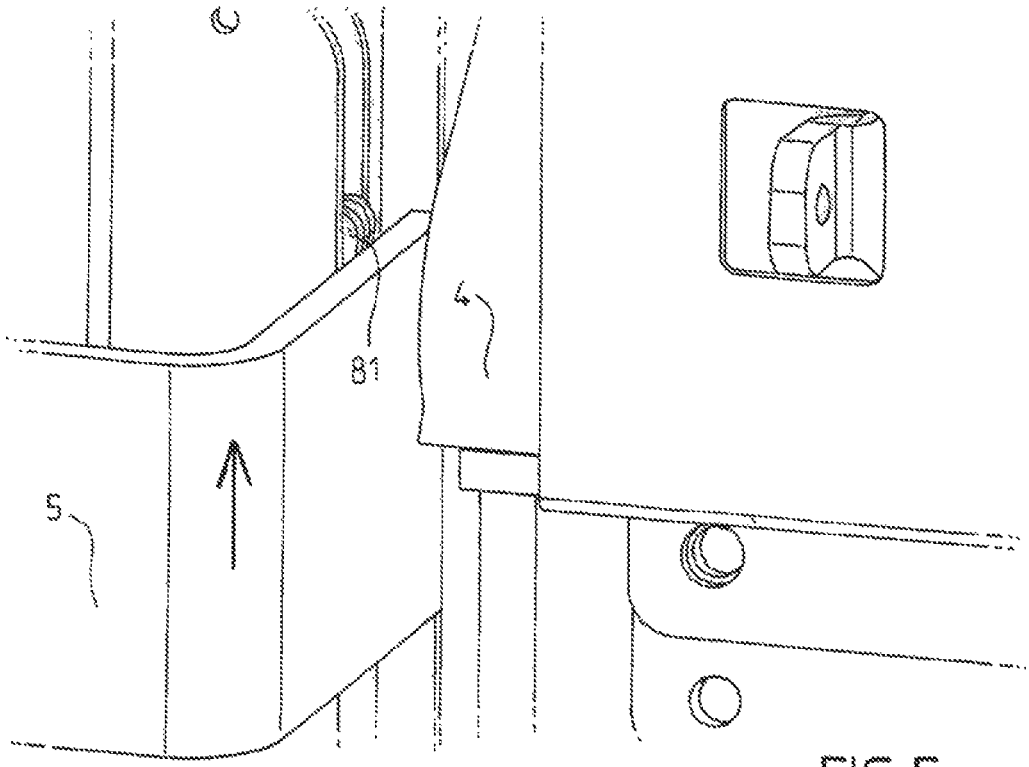
FIG. 5 is a view of the device such as is shown in FIG. 4 showing the retracting of the supporting means by the action of the locking element during the opening of the door.
Figure 6:
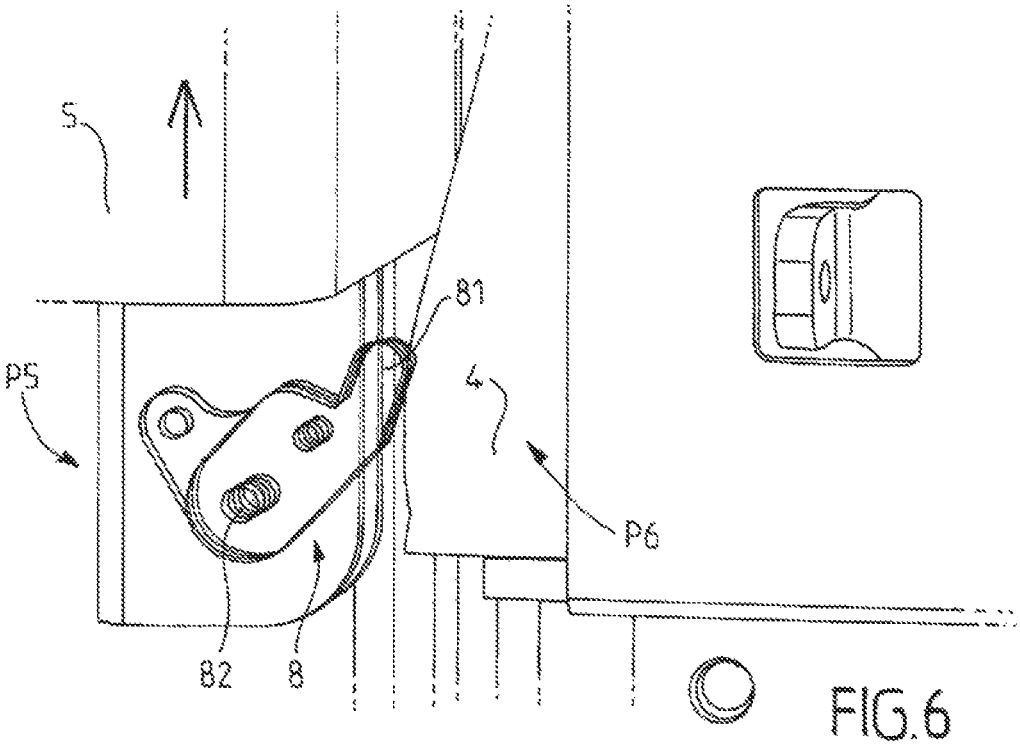
FIG. 6 is a view of the device such as is shown in FIG. 5, with the door being actuated when opening, the locking element having escaped from said supporting means.

This means of maintaining 8 as such allows for the passage of the locking element 5 during the opening of the door, such as is shown in FIG. 4. During this opening, and such as shown in FIGS. 4 to 6, the locking element 5 engages with the supporting means 8, in particular the pivoting finger causing it to retract. Once the pivoting finger of supporting means is retracted, the locking element 5 escapes from this finger and continues its translation, in particular to the final opening of the door.

Figure 7:
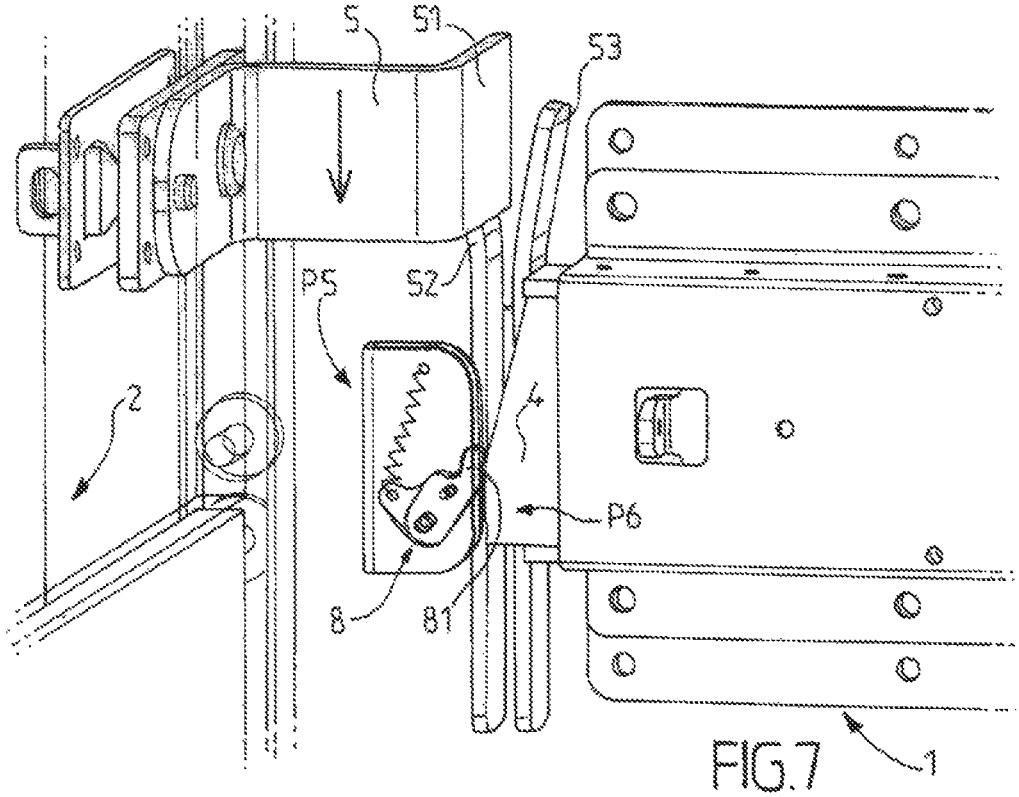
FIG. 7 is a view subsequent to the view such as shown in FIG. 6, when the door is actuated when closing.

The supporting means 8 are then, such as shown in FIG. 6 or 7, in a position, P5, separate from said released positions P3 and from the previously described engaged position P4. In the position P5, such as is shown in FIG. 6 or 7, the finger makes contact with the end of the bolt of the locking member 4. In this position P5, the supporting means 8, in particular the finger maintain the locking member 4 in an intermediary position P6 between the position P1 and the previously described position P2.

During the closing of the door such as is shown in FIG. 7, the end 51 of the locking element 5 again enters between the guide rails 52, 53, this end 51 interacting with an angled corner 10 of the locking member 4, located at the end of the bolt, intended to interact with said locking element 5 during the closing of the door in translation.

Figure 8:
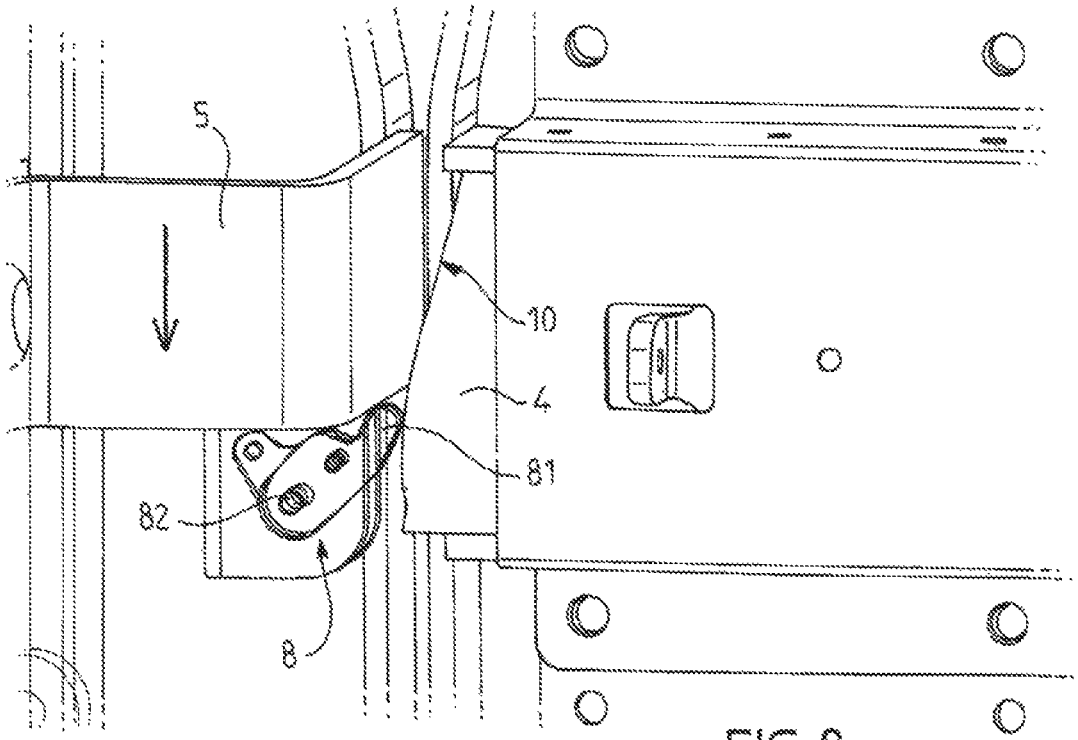
FIG. 8 is a view of the device such as is shown in FIG. 7, the locking element interacting with the supporting means in such a way as to cause the return of the supporting means in said released position P3, the locking element interacting with an angled corner of the locking member, allowing for the retracting of the member against the retaining force of the resilient means.
Figure 9:
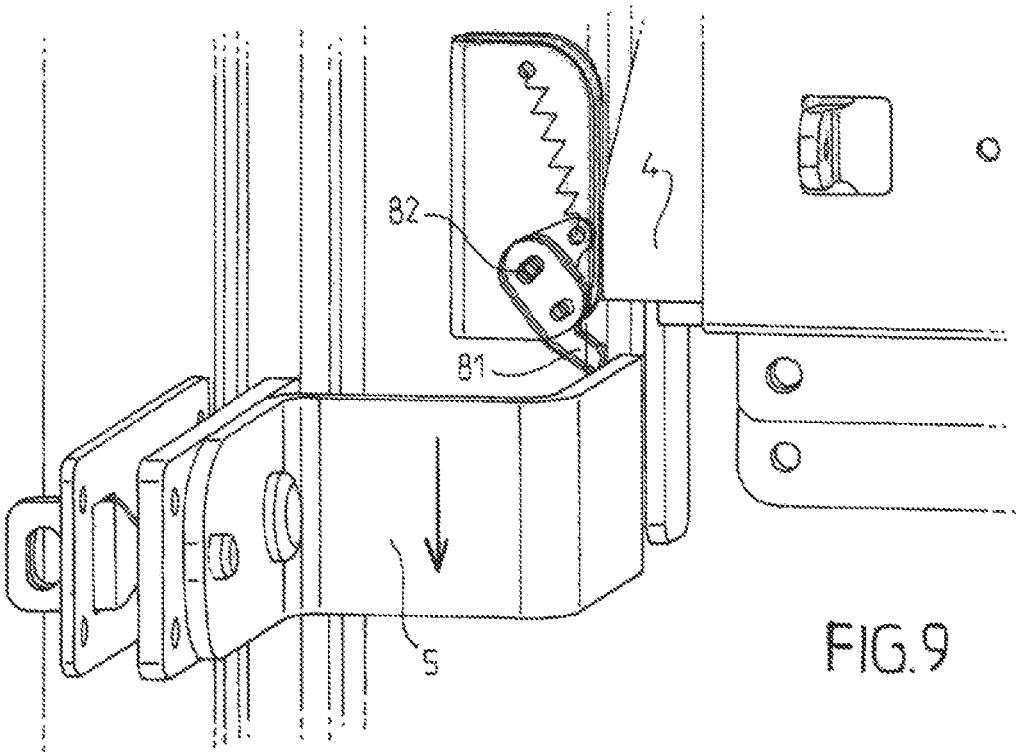
FIG. 9 is a view subsequent to the view in FIG. 8 showing the return of the supporting means in the released position.
Figure 10:
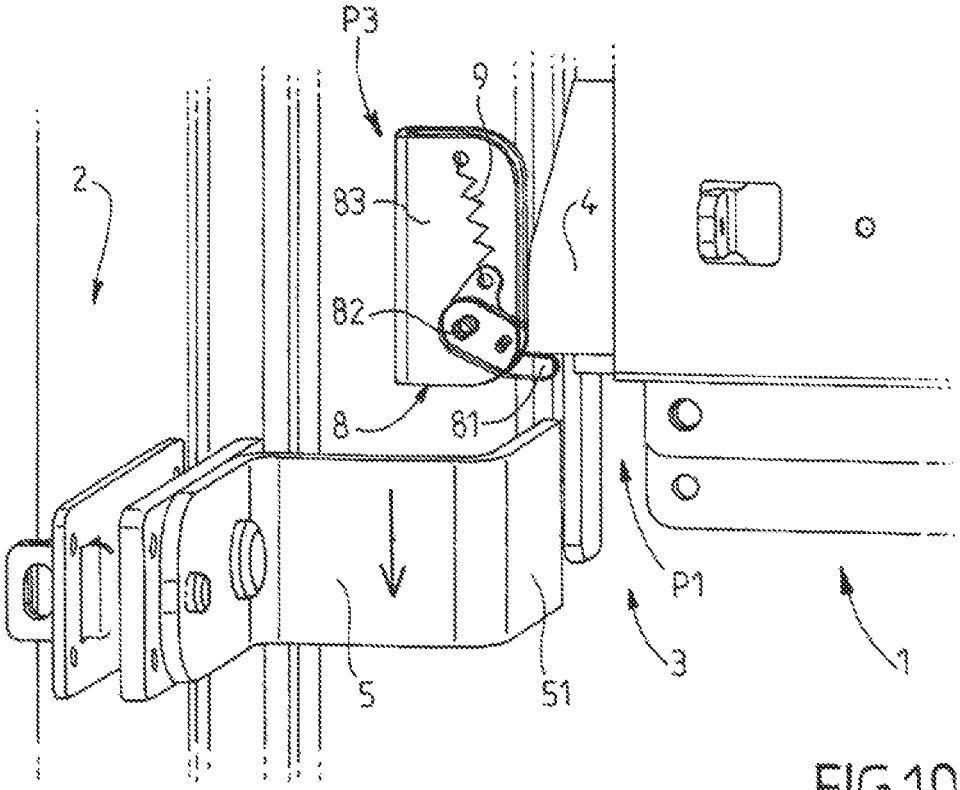
FIG. 10 is a view subsequent to FIG. 9, the locking element having escaped from the supporting means, the supporting means being in their released position P3, the locking member in the locked position P1.

This angled corner 10 makes it possible, by the action of the locking element 5 to push back the locking member 4 against the retaining force of the resilient means 7, as such authorising the passage of said locking element 5. During this return, the locking element 5 engages with the supporting means 8, in particular the pivoting finger, in order to cause the return of the supporting means from said position P5 to the released position P3, such as shown in FIGS. 8 to 10. Once the door is closed 10, the locking member 4 is as such in its locked position P1 and the supporting means 8 in their initial released position P3.

Advantageously, the application can provide a safety arrangement making it possible to open the door even in the event of a failure of the device 3 for locking or more simply in the case of a loss of power to the electric means 6, such as for example battery failure.

To this effect, said locking element 5 can be provided integral with the door by the intermediary of an articulation 11, in particular of a pivot of axis of rotation substantially perpendicular to the plane of the door when closed. A secure locking element, such as a personalised recessed screw, or a pin secured by a padlock, accessible in a removable manner on the exterior of the door, allows for the locking of the articulation by engaging in particular on a bore of the locking element 5.

The articulation when released (secure locking element removed) then authorises the free opening of the door 2 even when the locking member is in said locked position.

Figure 11:
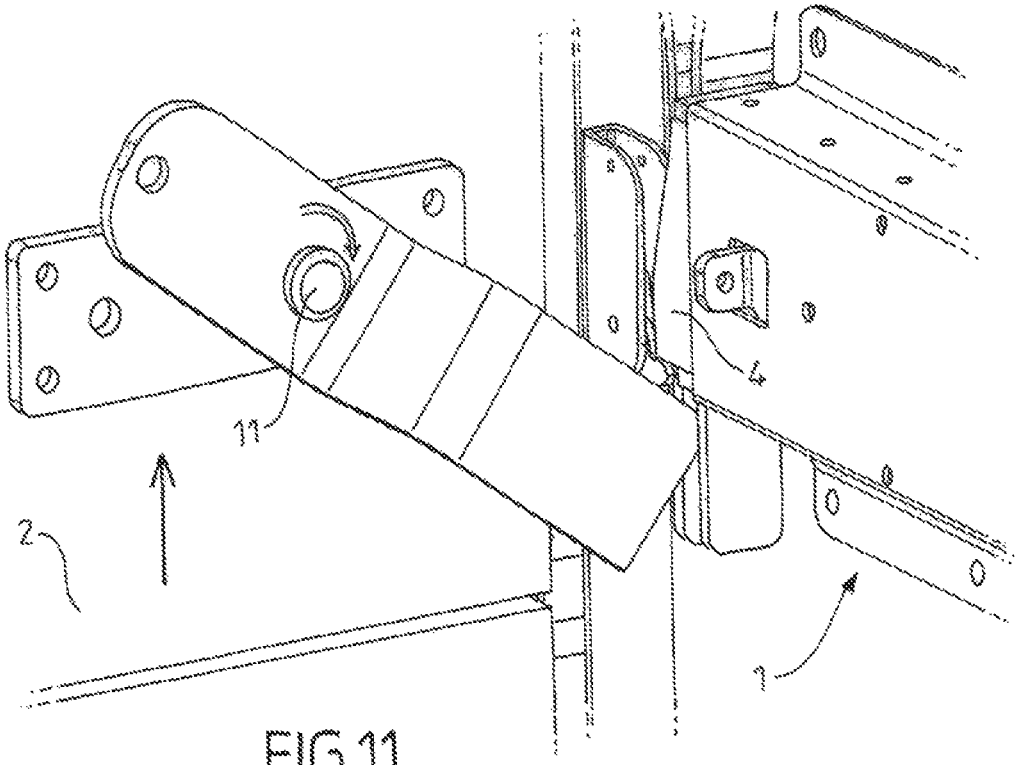
FIG. 11 is a view of the locking element when the secure locking element is removed, the opening of the door causing the rotation of the locking element, and as such, the free opening of the door while the locking member is in said locked position.
Figure 12:
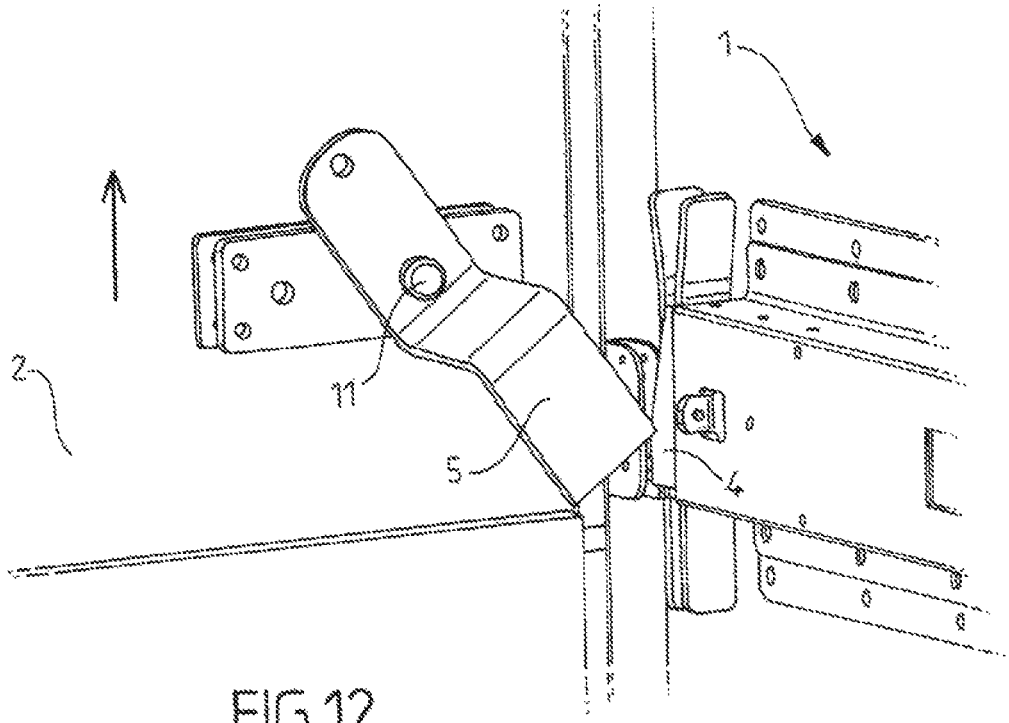
FIG. 12 is a view consecutive to FIG. 11.

Such as shown according to FIGS. 11 and 12 in particular, the opening of the door then causes the rotation of the locking element 5 according to the pivot in such a way as to authorise the opening of the door.

Note that this safety arrangement can be implemented independently of the previously described supporting means 8.

Naturally, other embodiments could have been considered without however leaving the scope of the invention defined by the claims hereinafter.

The invention claimed is:

1. A vehicle body shell (1), comprising:

an opening;

a door (2) provided on said opening that alternately opens or closes said opening, said door having a locking element (5) provided thereon; and a locking device (3) for locking the door in a closed position, said locking device (3) comprised of a locking member (4), mobile between a locked position P1 and an unlocked position P2, that interacts with said locking element (5) to alternately lock or unlock with the locking element (5), an electromagnetic means (6) that operatively moves the locking member (4) from said locked position P1 to said unlocked position P2, resilient means (7) that applies a first elastic force upon the locking member (4) that urges the locking member (4) from said unlocked position P2 to said locked position P1, and supporting means (8) that is mobile at least between a released first position P3, corresponding to a mode when the locking member (4) is in said locked position P1, to a stable engaged second position P4 that permits said supporting means (8) to interact with the locking member (4) in said unlocked position P2 in such a way as to counter the first elastic force of the resilient means (7) by mechanically maintaining the locking member (4) in said unlocked position P2, said supporting means also being retractable by action of the locking element (5) during movement of the door (2), a spring means (9) applying a second elastic force upon said supporting means (8) that urges said supporting means (8) from said released first position P3 to said engaged second position P4, wherein said supporting means (8), in said stable engaged second position P4, maintains the locking member (4) in said unlocked position P2 while the door is in a closed position, and wherein when the locking member (4) is actuated by said electromagnetic means from said locked position P1 to said unlocked position P2, the action of the spring means (9) causes a simultaneous movement of the supporting means (8) from the released first position P3 to said engaged second position P4, while the door is in the closed position.

2. The body shell according to claim 1, wherein the locking member (4) is constituted by a bolt movable in translation between said locked position P1 and said unlocked position P2, and wherein the supporting means (8) are constituted of a pivoting finger, which in said released first position P3 presses on a lateral section of the locking member (4) and which, when said locking member (4) is controlled to open, escapes from the lateral section by the action of said spring means (9) and pivots until said supporting means (8) enters said engaged second position P4 in which an engaged end (81) of said finger supports an end of the locking member (4) on a concave portion of said locking member (4).

3. The body shell according to claim 1, wherein the locking member (4) and said supporting means (8) are integral with the body shell (1) and said locking element (5) is integral with the door (2).

4. The body shell according to claim 1, wherein the supporting means (8) is configured to retract in response to an action of said locking element (5) during opening action of the door.

5. The body shell according to claim 4, wherein, when retracted by the action of the locking element (5), the supporting means (8) assume a third position P5, and maintain the locking member (4) in an intermediary position P6 between the locked position P1 and said unlocked position P2.

6. The body shell according to claim 1, wherein said locking element (5) is positioned to interacts with said supporting means (8) during the movement of the door in such a way as to cause the supporting means (8) to return to said released position P3.

7. The body shell according to claim 6, wherein the said locking element (5) interacts with said supporting means (8) to cause the supporting means (8) to return to said released position (P3) during the closing of the door (2).

8. The body shell according to claim 1, wherein the locking member (4) has an angled corner (10) that interacts with said locking element (5) during the closing of the door to move the locking member (4) against the first elastic force of the resilient means (7).

9. The body shell according to claim 3, wherein said locking element (5) is constituted by a folded plate having an end (51) that operatively abuts with said locking member (4) by way of said supporting means (8) when the door is in a closed position and said locking member (4) is in said locked position P1.

10. The body shell according to claim 9, further comprising:

rails (52, 53), integral with the body shell, that guide the end (51) of said folded plate in a vicinity of the locking member (4) during the movement of the door.

11. The body shell according to claim 1, wherein said locking element (5) is connected to the door by way of an articulation (11) that is lockable by a secure locking element, said secure locking element positioned to be accessible in a removable manner one an exterior of the door for locking the articulation, said articulation, when released, permits the door, in the closed position, to be opened while the locking member is in said locked position.

12. The body shell according to claim 1, wherein the door is any of a lift door, a sliding door, or a swinging door.

13. The body shell according to claim 2, wherein the locking member (4) and said supporting means (8) are integral with the body shell (1) and said locking element (5) is integral with the door (2).

14. The body shell according to claim 2, wherein the supporting means (8) is configured to retract in response to an action of said locking element (5) during opening action of the door.

15. The body shell according to claim 2, wherein said locking element (5) is positioned to interacts with said supporting means (8) during the movement of the door in such a way as to cause the supporting means (8) to return to said released position P3.

16. The body shell according to claim 2, wherein the locking member (4) has an angled corner (10) that interacts with said locking element (5) during the closing of the door to move the locking member (4) against the first elastic force of the resilient means (7).

17. The body shell according to claim 1, wherein said locking element (5) is constituted by a folded plate having an end (51) that operatively abuts with said locking member (4) by way of said supporting means (8) when the door is in a closed position and said locking member (4) is in said locked position P1.

18. The body shell according to claim 2, wherein said locking element (5) is constituted by a folded plate having an end (51) that operatively abuts with said locking member (4)

by way of said supporting means (8) when the door is in a closed position and said locking member (4) is in said locked position P1.

19. The body shell according to claim 2, wherein said locking element (5) is connected to the door by way of an articulation (11) that is lockable by a secure locking element, said secure locking element positioned to be accessible in a removable manner on an exterior of the door for locking the articulation, said articulation, when released, permits the door, in the closed position, to be opened while the locking member is in said locked position.

* * * * *